US008596369B2

(12) United States Patent
Andersen et al.

(10) Patent No.: US 8,596,369 B2
(45) Date of Patent: Dec. 3, 2013

(54) EXTENDING LINES THROUGH, AND PREVENTING EXTRUSION OF, SEAL ELEMENTS OF PACKER ASSEMBLIES

(75) Inventors: Kristian Andersen, Stavanger (NO); Sølve S. Lyng, Rykkinn (NO); Jonny Haugen, Randaberg (NO)

(73) Assignee: Halliburton Energy Services, Inc., Houston, TX (US)

( * ) Notice: Subject to any disclaimer, the term of this patent is extended or adjusted under 35 U.S.C. 154(b) by 152 days.

(21) Appl. No.: 12/965,513

(22) Filed: Dec. 10, 2010

(65) Prior Publication Data

US 2012/0145412 A1 Jun. 14, 2012

(51) Int. Cl.
*E21B 33/12* (2006.01)

(52) U.S. Cl.
CPC ..... *E21B 33/1208* (2013.01)
USPC ..... 166/387; 166/118; 166/180; 166/241.6

(58) Field of Classification Search
CPC ..... E21B 23/06; E21B 23/1216
USPC ..... 166/387, 118, 180, 241.6
See application file for complete search history.

(56) References Cited

U.S. PATENT DOCUMENTS

| | | | |
|---|---|---|---|
| 2,253,092 | A | 8/1941 | Prancer |
| 2,546,377 | A | 3/1951 | Turechek |
| 6,325,144 | B1 | 12/2001 | Turley et al. |
| 6,343,791 | B1 | 2/2002 | Anyan et al. |
| 6,439,313 | B1 | 8/2002 | Thomeer et al. |
| 6,695,057 | B2 | 2/2004 | Ingram et al. |
| 7,114,558 | B2 | 10/2006 | Hoffman et al. |
| 7,222,676 | B2 | 5/2007 | Patel et al. |
| 7,730,940 | B2 | 6/2010 | Knippa et al. |
| 7,762,322 | B2 | 7/2010 | Andersen et al. |
| 2006/0121340 | A1 | 6/2006 | Kawai et al. |
| 2007/0012436 | A1 | 1/2007 | Freyer |
| 2008/0110626 | A1 | 5/2008 | Allison et al. |
| 2009/0159265 | A1 | 6/2009 | Freyer |
| 2009/0277648 | A1 | 11/2009 | Nutley et al. |
| 2009/0283254 | A1 * | 11/2009 | Andersen et al. ..... 166/118 |

FOREIGN PATENT DOCUMENTS

| | | | |
|---|---|---|---|
| CA | 2151525 | A1 | 12/1996 |
| CN | 201241659 | Y | 5/2009 |
| RU | 2201495 | C2 | 3/2003 |
| RU | 82748 | U1 | 5/2009 |

OTHER PUBLICATIONS

Search Report issued Jul. 10, 2012 for International Application PCT/US11/63077, 6 pages.
Written Opinion issued Jul. 10, 2012 for International Application PCT/US11/63077, 4 pages.

* cited by examiner

*Primary Examiner* — Cathleen Hutchins
(74) *Attorney, Agent, or Firm* — Smith IP Services, P.C.

(57) ABSTRACT

A packer assembly can include an annular seal element and an end ring including leaves formed on a body of the end ring, whereby the leaves are biased radially outward when the seal element extends radially outward. A method of sealing an annulus in a subterranean well can include positioning a circumferential series of leaves radially outwardly overlying an annular seal element of a packer assembly, and the leaves pivoting radially outward in response to swelling of the seal element. Another packer assembly can include an annular seal element which swells in response to contact with a selected fluid in the well, and an end ring including an end ring body with a removable portion being engaged with the end ring body via interlocking profiles.

14 Claims, 11 Drawing Sheets

EXTENDING LINES THROUGH, AND PREVENTING EXTRUSION OF, SEAL ELEMENTS OF PACKER ASSEMBLIES

BACKGROUND

This disclosure relates generally to equipment utilized and operations performed in conjunction with a subterranean well and, in an example described below, more particularly provides for extending lines through, and preventing extrusion of, packer seal elements.

An annulus differential pressure rating of a packer assembly can be limited by extrusion of the packer assembly's seal element. It is beneficial to be able to extend lines longitudinally through the seal element.

Therefore, it will be appreciated that improvements are needed in the art of constructing packer assemblies.

SUMMARY

In the disclosure below, a packer assembly and associated methods are provided which brings improvements to the art. One example is described below in which lines are extended longitudinally through a seal element and an end ring. Another example is described below in which extrusion of the seal element is prevented by use of radially extendable leaves on the end ring.

In one aspect, this disclosure provides to the art a packer assembly for use in a subterranean well. The packer assembly can include an annular seal element and at least one end ring. The end ring includes leaves formed on a body of the end ring, whereby the leaves are biased radially outward when the seal element extends radially outward.

In another aspect, a method of sealing an annulus in a subterranean well is provided by this disclosure. The method can include positioning a circumferential series of leaves radially outwardly overlying an annular seal element of a packer assembly, and the leaves pivoting radially outward in response to swelling of the seal element.

In yet another aspect, a disclosed packer assembly for use in a subterranean well can include an annular seal element which swells in response to contact with a selected fluid in the well, and at least one end ring including an end ring body with a removable portion. The removable portion is engaged with the body of the end ring via interlocking profiles.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
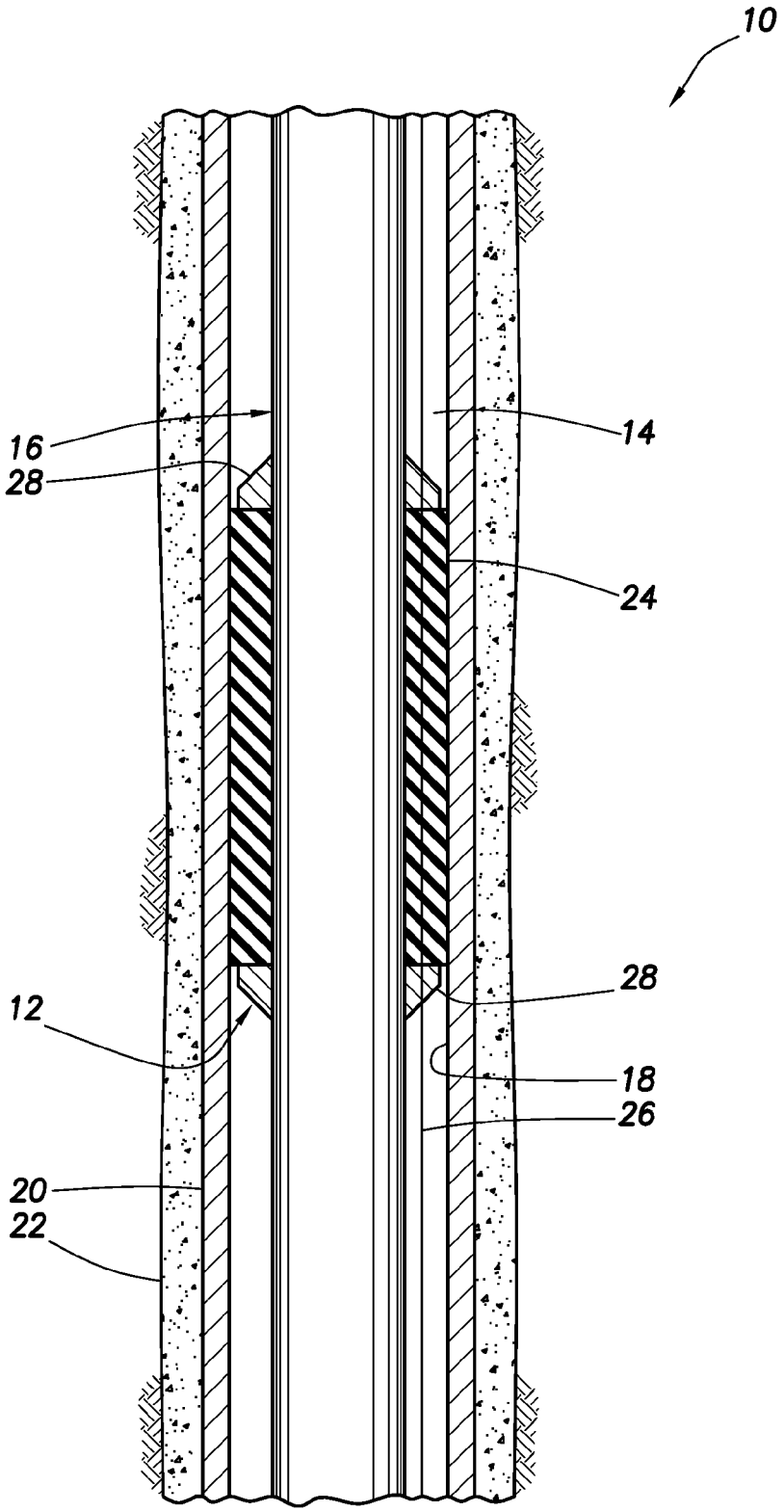
FIG. 1 is a schematic partially cross-sectional view of a well system and associated method which can embody principles of the present disclosure.

Representatively illustrated in FIG. 1 is a well system 10 and associated method which can embody principles of this disclosure. In the well system 10, a packer assembly 12 is used to seal off an annulus 14 formed between a tubular string 16 and a wellbore 18. In the example of FIG. 1, the wellbore 18 is lined with casing 20 and cement 22, but in other examples, the wellbore could be uncased or open hole.

The packer assembly 12 is representatively of the type known to those skilled in the art as a swellable packer, but other types of packers can incorporate the principles of this disclosure. In the FIG. 1 example, a seal element 24 of the packer assembly 12 is extended radially outward into sealing contact with the wellbore 18 to seal off the annulus 14. This radial extension of the seal element 24 can be due to swelling of a swellable material in response to contact with a selected fluid.

The term "swell" and similar terms (such as "swellable") are used herein to indicate an increase in volume of a swellable material. Typically, this increase in volume is due to incorporation of molecular components of an activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material is in this example preferably a hydrocarbon fluid (such as oil or gas). In the well system 10, the swellable material swells when the fluid comprises the activating agent (e.g., when the fluid enters the wellbore 18 from a formation surrounding the wellbore, when the fluid is circulated to the packer assembly 12, when the fluid is released from a chamber carried with the packer assembly, etc.). In response, the seal element 24 seals off the annulus 14 and can apply a gripping force to the wellbore 18.

The activating agent which causes swelling of the swellable material could be comprised in any type of fluid. The activating agent could be naturally present in the well, or it could be conveyed with the packer assembly 12, conveyed separately or flowed into contact with the swellable material in the well when desired. Any manner of contacting the activating agent with the swellable material may be used in keeping with the principles of this disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-0020662, the entire disclosures of which are incorporated herein by this reference.

As another alternative, the swellable material may have a substantial portion of cavities therein which are compressed or collapsed at surface conditions. Then, after being placed in the well at a higher pressure, the material swells by the cavities filling with fluid.

This type of apparatus and method might be used where it is desired to expand the swellable material in the presence of gas rather than oil or water. A suitable swellable material is described in U.S. Published Application No. 2007-0257405, the entire disclosure of which is incorporated herein by this reference.

Preferably, the swellable material used in the well tool 12 swells by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined, if desired.

It should, thus, be clearly understood that any swellable material which swells when contacted by a predetermined activating agent may be used in keeping with the principles of this disclosure. The swellable material could also swell in response to contact with any of multiple activating agents. For example, the swellable material could swell when contacted by hydrocarbon fluid and/or when contacted by water.

In the FIG. 1 example, one or more lines 26 extend longitudinally through the packer assembly 12. The lines 26 extend through the seal element 24 and end rings 28 which longitudinally straddle the seal element. The end rings 28 support the seal element 24 on the tubular string 16 and operate to minimize extrusion of the seal element through the annulus 14 as the seal element swells.

The lines 26 may be electrical, hydraulic, optical, and/or any other type of lines. The lines 26 may be in the form of conduits, wires, cables, optic fibers (or other types of optical waveguides), flat packs, and/or in any other form. The lines 26 may be used for control signals, data transmission, communication, telemetry, and/or any other purpose.

Figure 2:
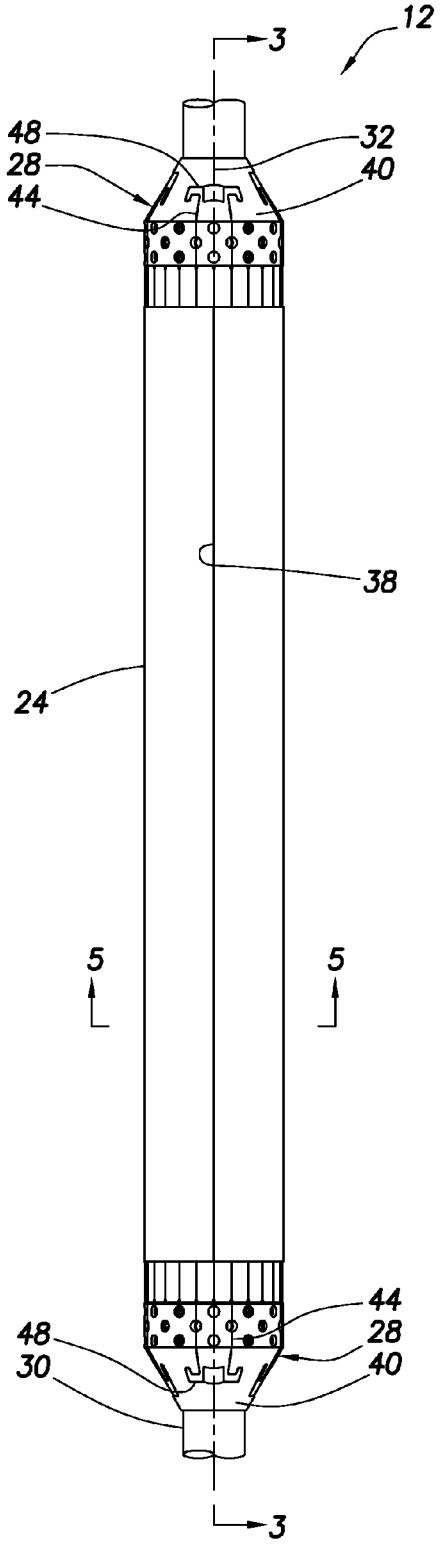
FIGS. 2-9 are schematic views of one example of a packer assembly which may be used in the system and method of FIG. 1.

Referring additionally now to FIG. 2, an enlarged scale detailed view of one example of the packer assembly 12 is representatively illustrated. The packer assembly 12 may be used in the well system 10 and method described above, or it may be used in any other well system in keeping with the principles of this disclosure.

Figure 3:
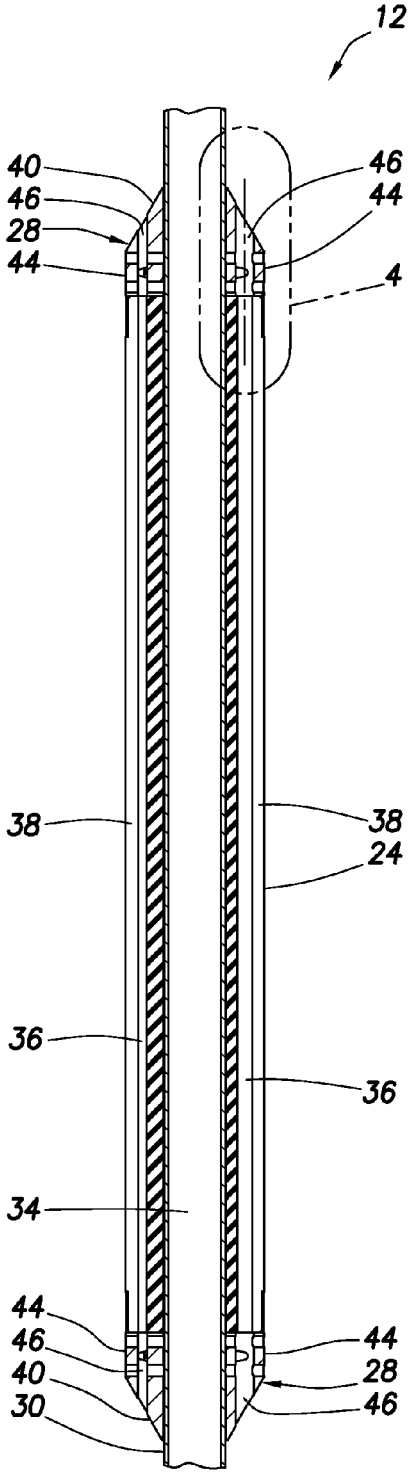
Figure 4:
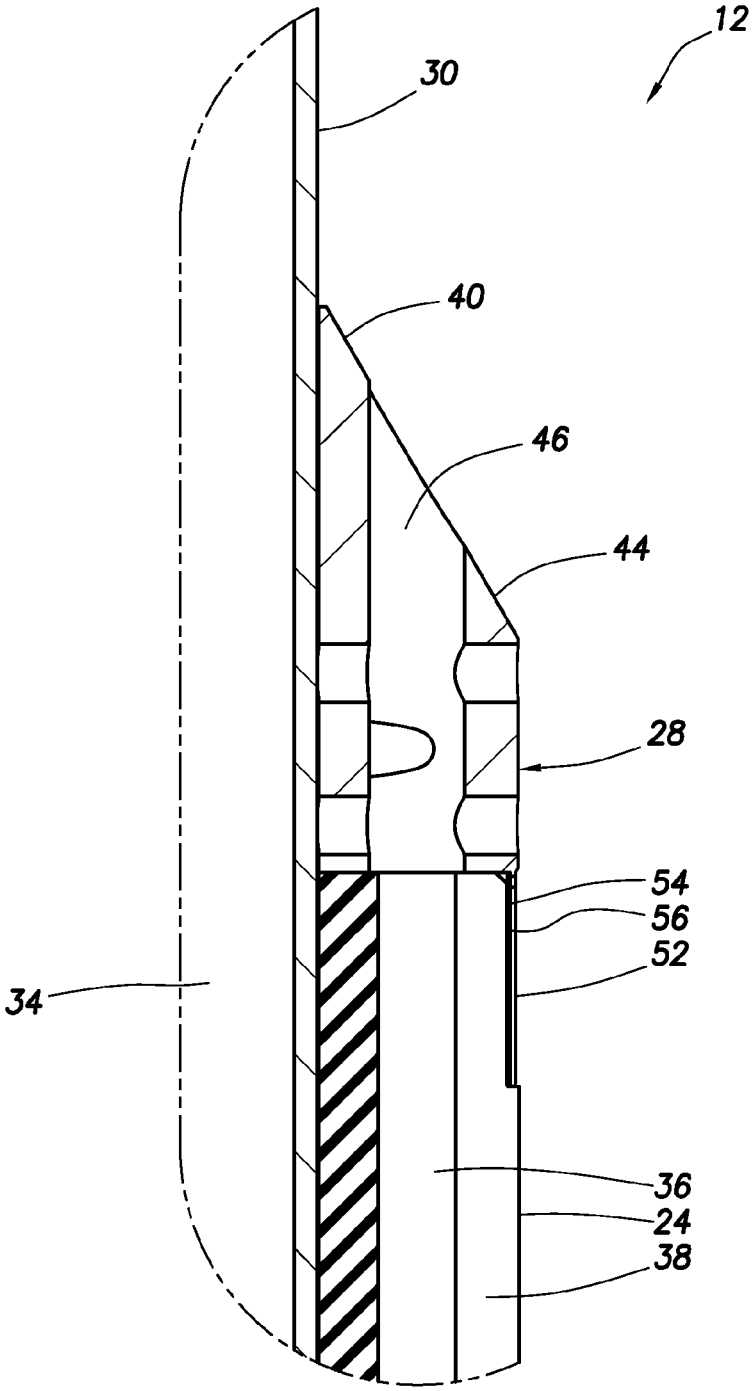

A cross-sectional view of the packer assembly 12 is illustrated in FIG. 3, and a further enlarged scale cross-sectional view of one of the end rings 28 is illustrated in FIG. 4. It may be seen in FIGS. 2-4 that this example of the packer assembly 12 includes the seal element 24 and end rings 28 on a base pipe 30, which is preferably provided with suitable end connections (not shown) for interconnecting the packer assembly in the tubular string 16.

Generally, these components are aligned along a longitudinal axis 32 of the packer assembly 12. A flow passage 34 extends longitudinally through the base pipe 30, so that flow can be permitted through the passage, even when the seal element 24 seals off the annulus 14 surrounding the packer assembly 12.

In the example of FIGS. 2-4, longitudinally extending channels 36 are provided in the seal element 24 for installation of the lines 26 therein. Slits 38 enable the lines 26 to be conveniently installed in the channels 36 from a side thereof (without having to feed the lines into the channels from their ends).

Four sets of channels 36 and slits 38 are provided in the example of FIGS. 2-4, and the channels are equally circumferentially spaced apart in the seal element 24. However, other numbers and arrangements of channels, lines, slits, etc., may be provided as desired.

Each of the end rings 28 includes a body 40 which encircles and is secured to the base pipe 30. The body 40 could be secured to the base pipe 30 by means of fasteners (such as set screws 42 depicted in FIG. 9), or the body could be welded to the base pipe or attached thereto by other means.

Each end ring 28 also includes one or more removable portions 44 which allow the lines 26 to be installed through the end ring from a side thereof (without having to feed the lines through openings 46 in the end ring from an end). The openings 46 are aligned with the channels 36 in the seal element 24, thereby enabling the lines 26 to be conveniently installed in the channels and openings from the side thereof as the tubular string 16 and packer assembly 12 are being run into the wellbore 18.

After inserting the lines 26 into the channels 36 and openings 46, the removable portions 44 are attached to the end ring bodies 40, thereby securing the lines to the packer assembly 12. The packer assembly 12 is then positioned in the well, and the seal element 24 is swelled to seal off the annulus 14. This swelling of the seal element 24 also causes the seal element to seal about the lines 26 in the channels 36, thereby preventing leakage about the lines.

In one feature of the end rings 28, the removable portions 44 are engaged with the end ring bodies 40 via longitudinally extending interlocking profiles 48. The interlocking profiles are preferably created by wire-cutting (e.g., using electrical discharge machining) the removable portions 44 from the end ring bodies 40, but other methods of forming the interlocking profiles may be used as desired. The interlocking profiles 48 are depicted in the drawings as having a J-shape, but other shapes may be used as desired.

Figure 5:
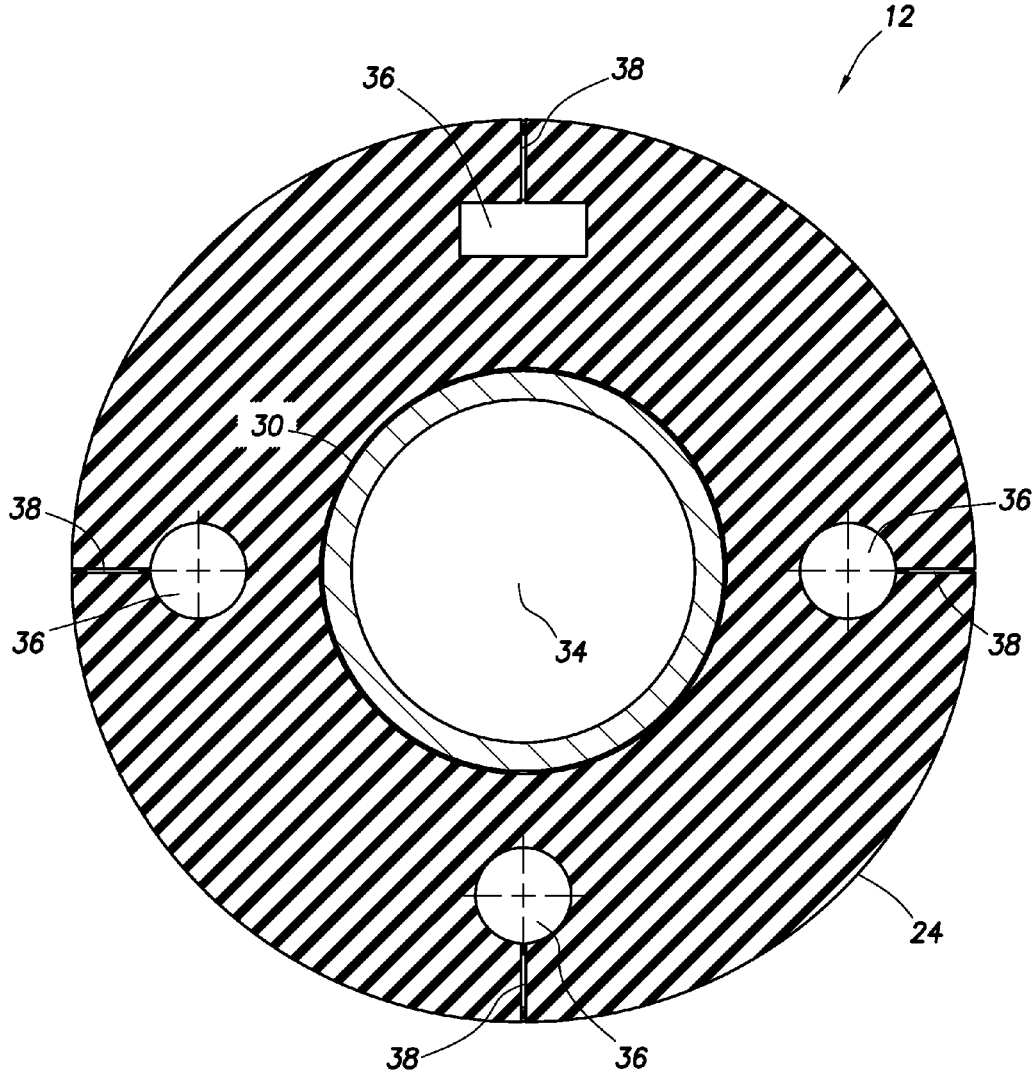
Figure 6:
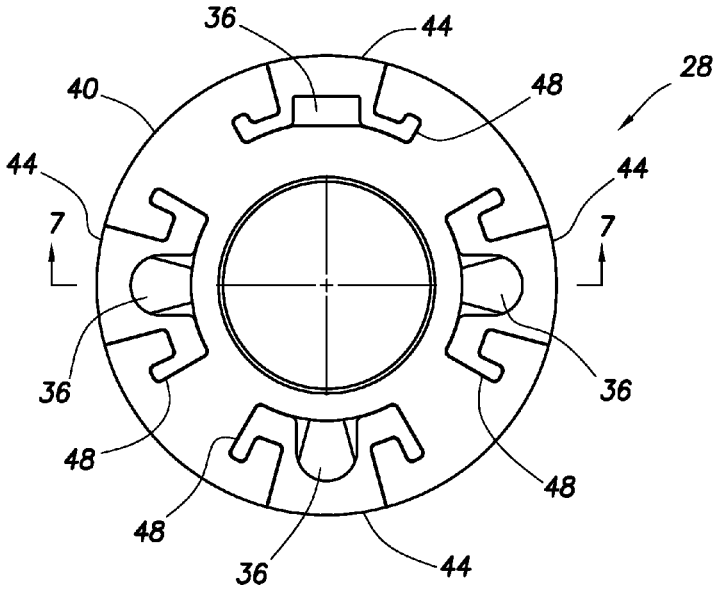
Figure 7:
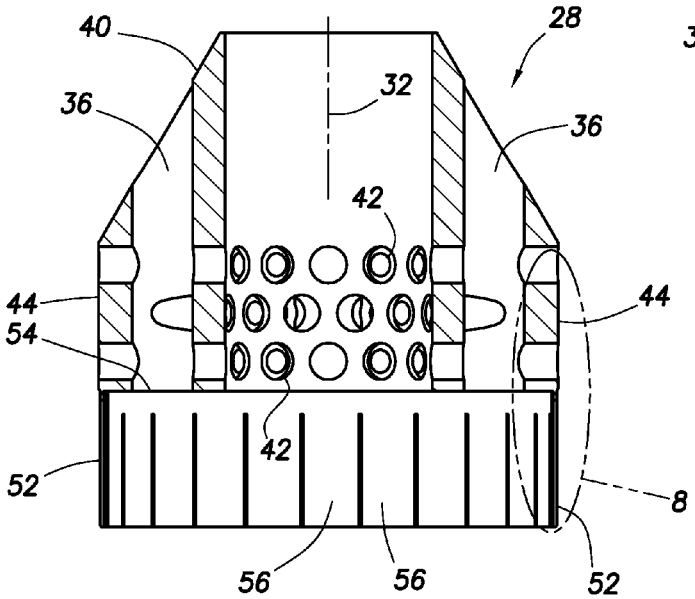
Figure 8:
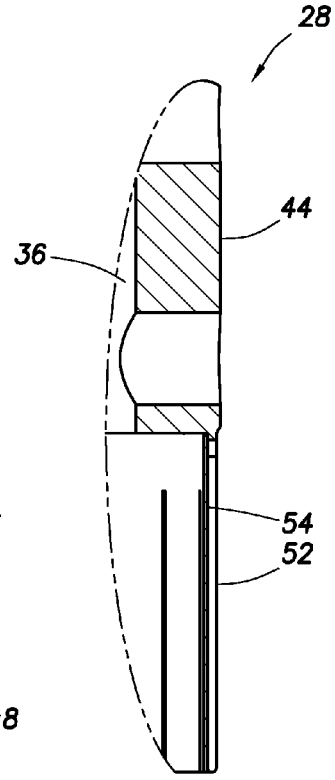

Referring additionally now to FIG. 5, a cross-sectional view of the packer assembly 12 is representatively illustrated, taken along line 5-5 of FIG. 2. In this view, the manner in which the channels 36 and slits 38 are configured in the seal element 24 can be clearly seen.

Note that one of the channels 36 has a rectangular shape, and the remaining channels have a circular shape. The rectangular channel 36 may be used for installation of a flat pack therein, and the other channels may be used for installation of cylindrical cables therein, but it should be understood that any combination of shapes may be used for the channels in keeping with the principles of this disclosure.

Referring additionally now to FIGS. 6-9, an end ring 28 is representatively illustrated apart from the remainder of the packer assembly 12. In these views it may be clearly seen that longitudinally extending leaves 50 are formed on the end ring body 40, and similar longitudinally extending leaves 52 are formed on the removable portions 44.

A sleeve-shaped insert 54 is installed in the end ring body 40, radially inward from the leaves 50. The insert 54 also has longitudinally extending leaves 56 formed thereon.

The leaves 50, 52, 56 radially outwardly overlie the ends of the seal element 24 (see, for example, FIG. 4). When the seal element 24 swells, the leaves 50, 52, 56 are pivoted radially outward, so that they extend across the annulus 14 radially between the end ring 28 and the wellbore 18, thereby preventing extrusion of the seal element past the leaves.

Preferably, the insert leaves 56 are circumferentially offset relative to the leaves 50, 52 on the body 40 and removable portions 44, so that there are no circumferential gaps exposed between the leaves. In this manner, the leaves 50, 52, 56 form an unbroken wall to prevent extrusion of the seal element 24, even after the leaves have been pivoted radially outward by the swelling of the seal element.

Figure 9:
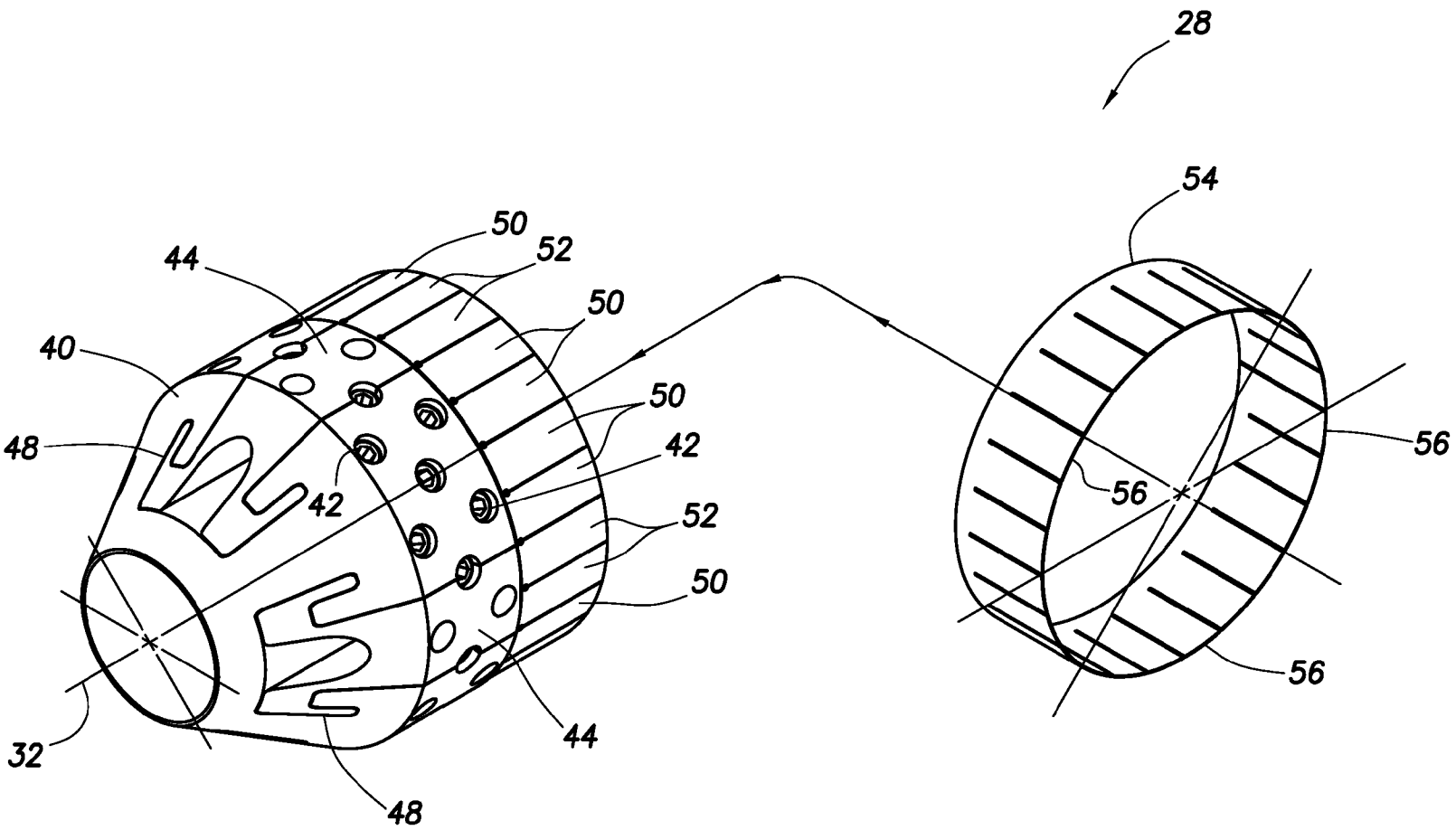

The insert 54 can be secured in the end ring 28 by adhesive bonding or other attachment means. The insert 54 could be a continuous cylindrical sleeve as depicted in FIG. 9, or it could be made in multiple sections, as described for another example below.

Referring additionally now to FIGS. 10-15, another example of the packer assembly 12 is representatively illustrated. In this example, the lines 26 are not equally circumferentially distributed in the seal element 24. Instead, the lines 26 are installed in a thickened side of the seal element 24 produced by an eccentric positioning of the seal element relative to the base pipe 30.

Figure 10:
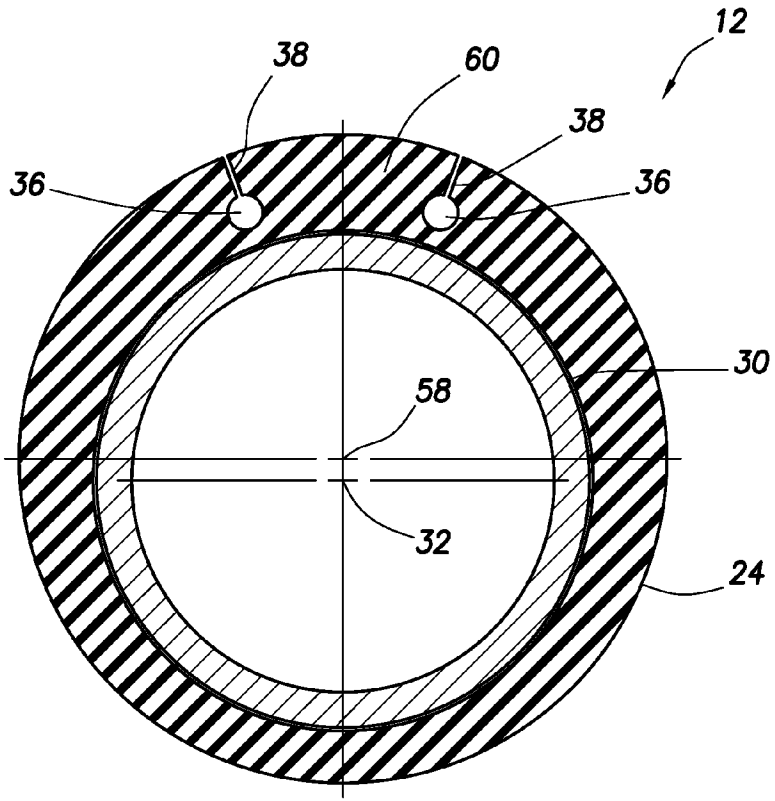

In FIG. 10, a cross-sectional view through the seal element 24 section of the packer assembly 12 is representatively illustrated. In this view, it may be seen that the outer diameter of the seal element 24 has a longitudinal axis 58 which is laterally offset relative to the longitudinal axis 32 of the base pipe 30 and the inner diameter of the seal element.

This eccentric positioning of the seal element 24 outer diameter produces a thickened side 60 of the seal element. The lines 26 are installed in channels 36 in this thickened side 60. The lines 26 are not shown in FIG. 10 for clarity of illustration, but the lines would preferably be installed in the channels 36 in the manner described above for the example of FIGS. 2-9.

Figure 11:
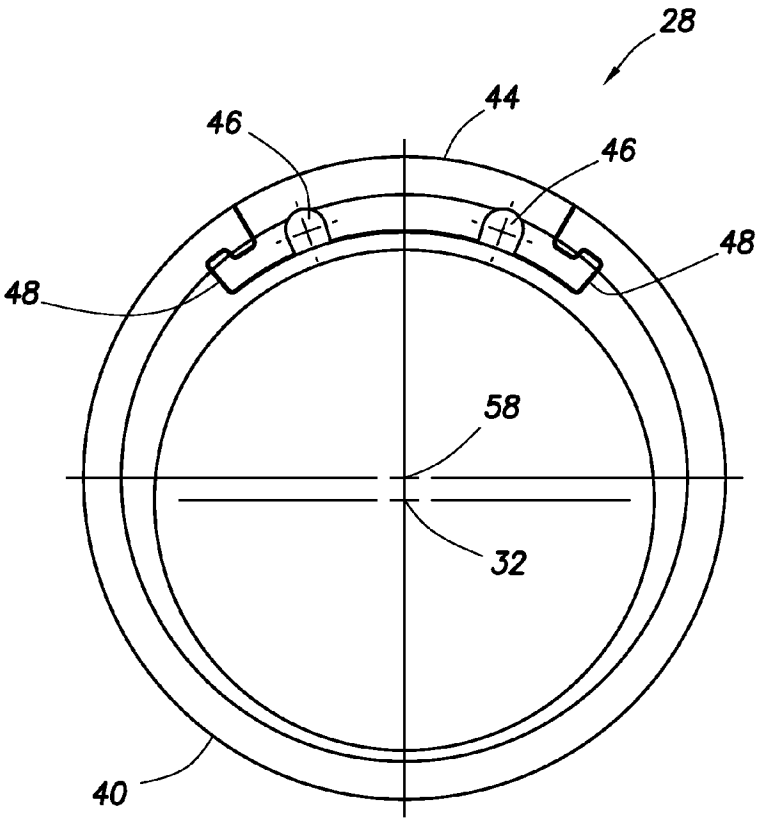
FIGS. 10-15 are schematic views of another example of the packer assembly.

In FIG. 11, an end view of the end ring 28 is representatively illustrated. Note that an outer diameter of the end ring 28 is eccentric relative to an inner diameter of the end ring. In addition, two of the openings 46 are bounded by the body 40 and one removable portion 44.

Figure 12:
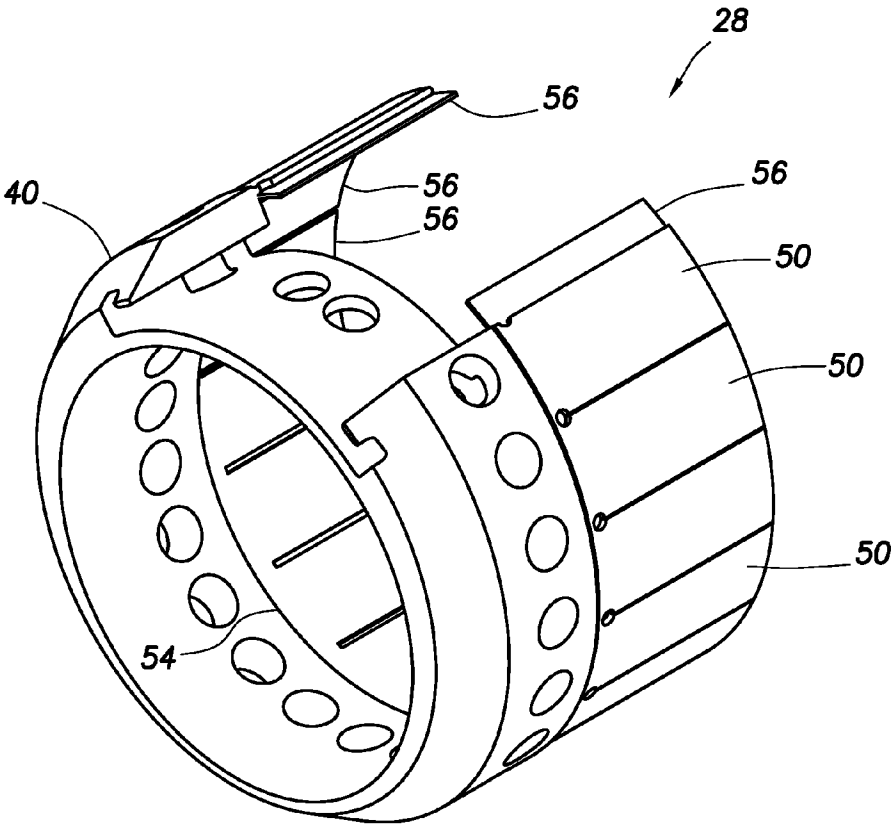

In FIG. 12, an isometric view of the end ring 28 with the portion 44 removed is representatively illustrated. In this view it may be seen that the insert 54 is circumferentially discontinuous where the portion 44 is removed from the body 40. This allows the lines 26 to be installed in the channels 36 and end ring 28 prior to attaching the removable portion 44 to the body 40.

Figure 13:
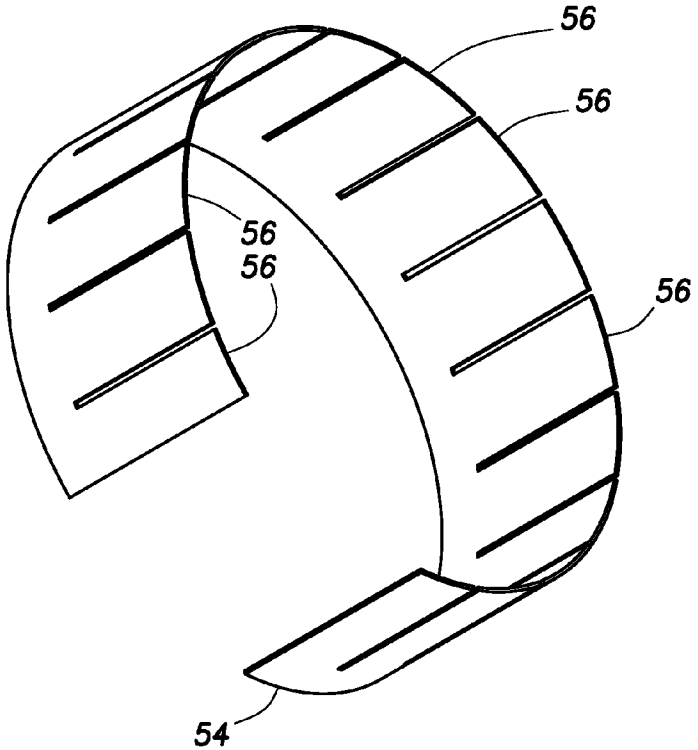
Figure 15:
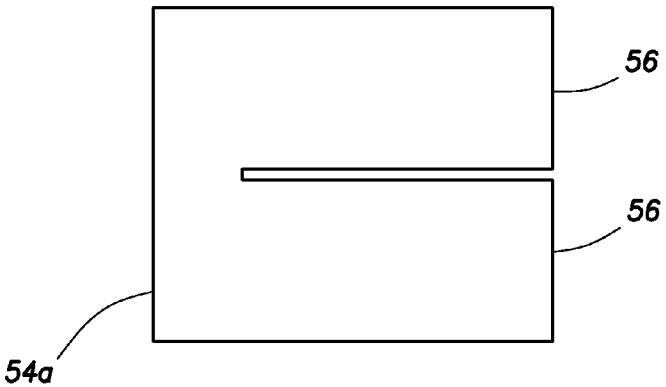
Figure 14:
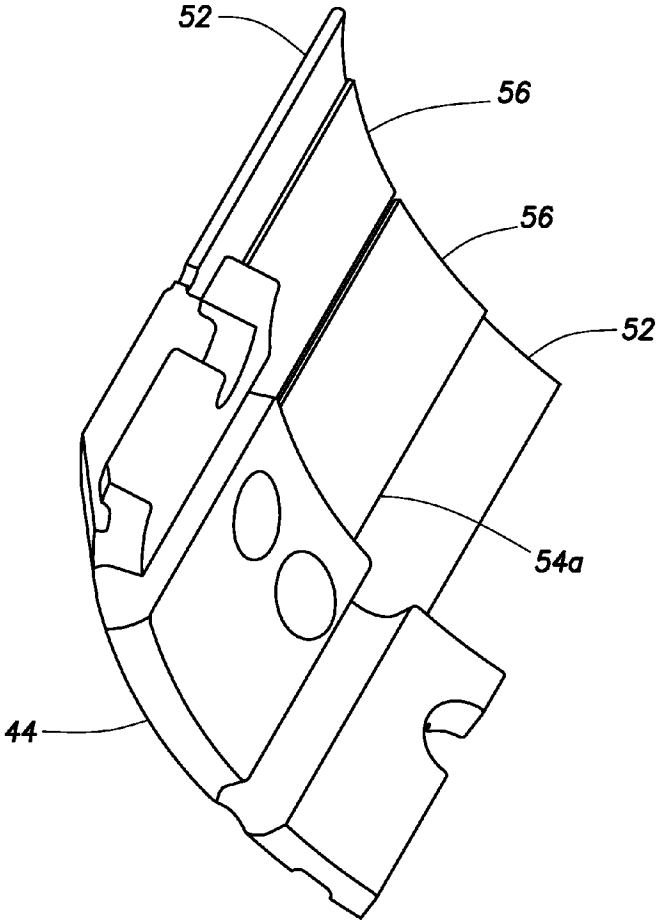
Figure 17:
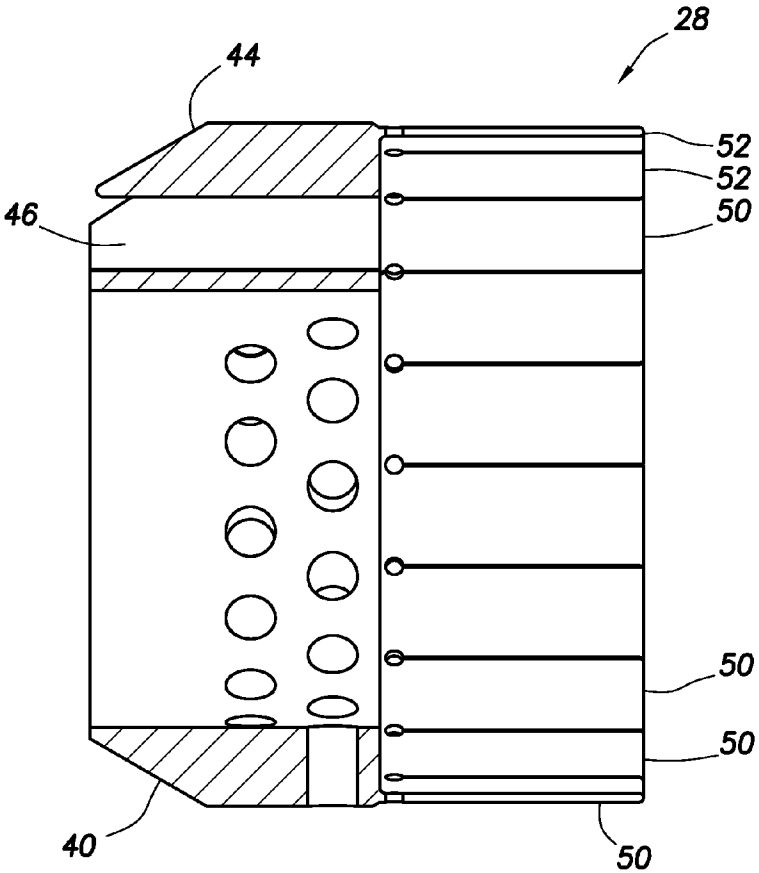
FIGS. 16-19 are schematic views of yet another example of the packer assembly.
Figure 16:
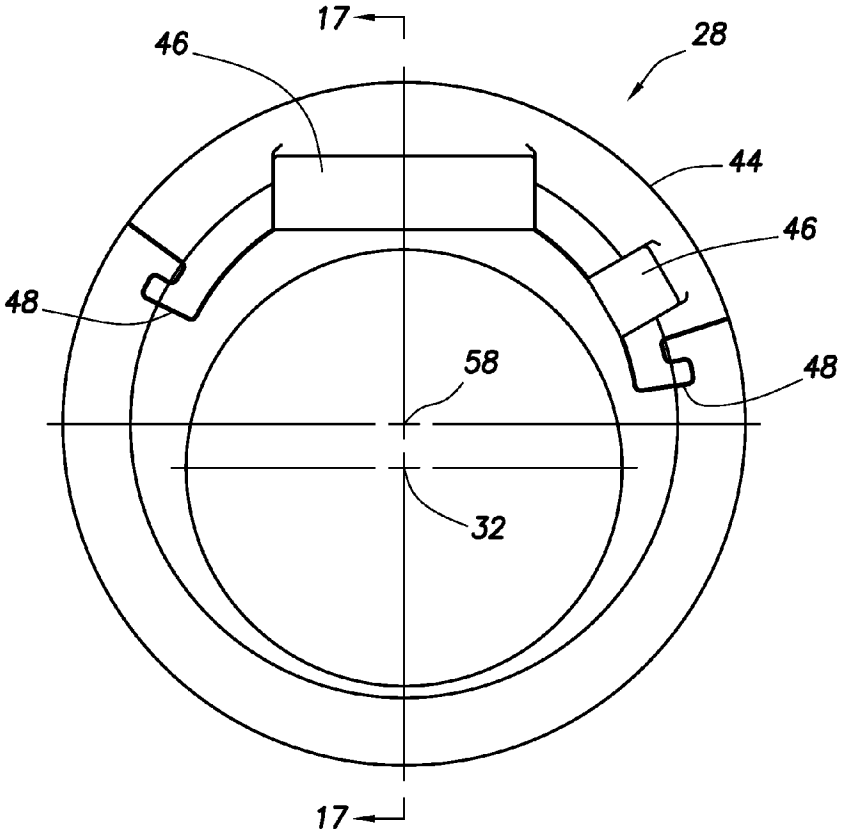
Figure 19:
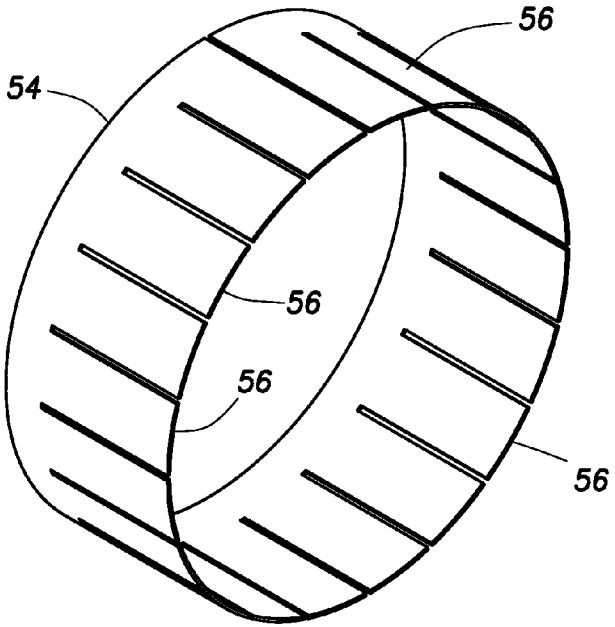

The insert 54 is illustrated in FIG. 13. In FIG. 14, the manner in which a section 54*a* of the insert 54 is attached to the removable portion 44 of the end ring 28 is illustrated. Note that this arrangement preserves the circumferential offset of the insert leaves 56 relative to the leaves 50, 52 on the body 40 and removable portion 44, so that no circumferential gaps are formed, even when the leaves are pivoted outward by swelling of the seal element 24. The section 54*a* of the insert 54 is depicted in FIG. 15, apart from the remainder of the end ring 28 and removable portion 44 thereof.

Another example is representatively illustrated in FIGS. 16-19. In this example, the openings 46 are shaped to accommodate two different sizes of flat pack lines 26. In addition, the lines 26 are positioned in a thickened side of the packer assembly 12 resulting from an eccentric outer diameter relative to an inner diameter of the packer assembly.

Figure 18:
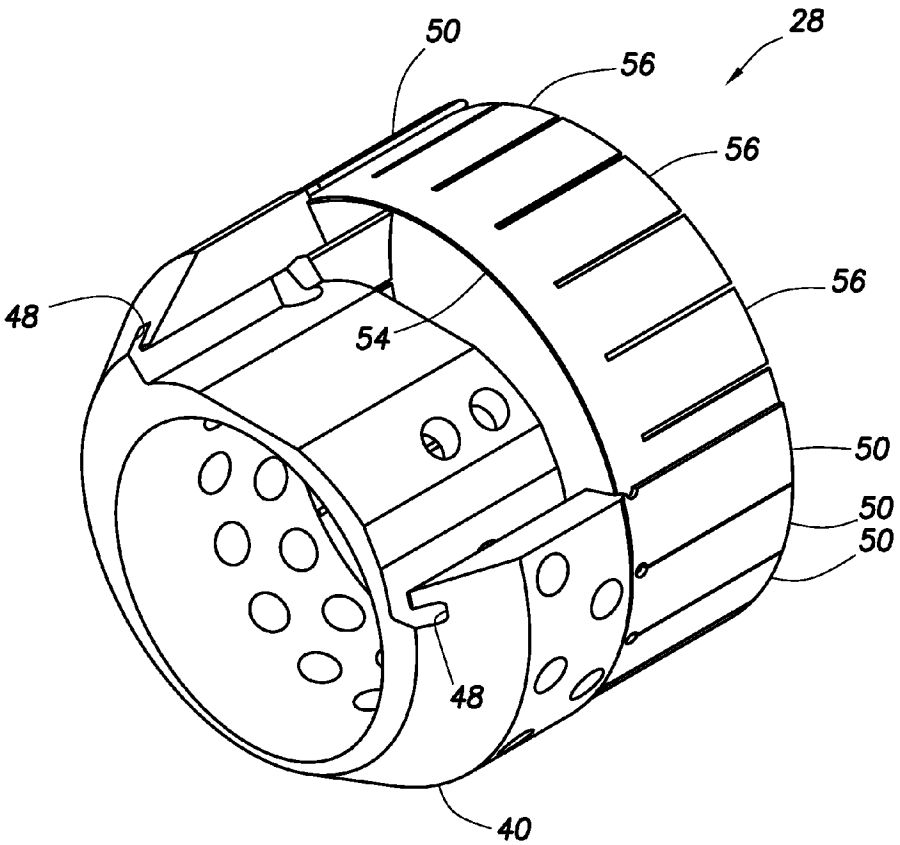

In FIG. 18, it may be seen that this example utilizes an insert 54 which has a generally cylindrical shape, but which is circumferentially split. A view of the insert 54 alone is provided in FIG. 19.

Although the end ring 28 examples are described above as including multiple unique features (e.g., the removable portions 44 and the leaves 50, 52, etc.), it should be clearly understood that any one or combination of these features could be included in an end ring within the scope of this disclosure, and it is not necessary for all of the unique features described above to be included in the end ring.

It may now be fully appreciated that the above disclosure provides several advancements to the art of constructing packer assemblies for use in wells. The examples of the packer assembly 12 described above have an end ring 28 which accommodates various types, numbers and spacings of lines 26, and which secures the lines using one or more removable portions 44. Extrusion of the seal element 24 in the annulus 14 is prevented by leaves 50, 52, 56 which pivot radially outward when the seal element 24 extends radially outward.

The above disclosure provides to the art a packer assembly 12 for use in a subterranean well. The packer assembly 12 can include an annular seal element and at least one end ring 28 including leaves 50 formed on a body 40 of the end ring 28. The leaves 50 are biased radially outward when the seal element 24 extends radially outward.

The seal element 24 may swell in response to contact with a selected fluid in the well.

A removable portion 44 of the end ring 28 may be engaged with the end ring body 40 via interlocking profiles 48.

The leaves 50 may overlie the seal element 24.

The end ring 28 may also include an insert 54 with leaves 56 formed thereon. The insert leaves 56 can be circumferentially offset relative to the end ring body leaves 50.

At least one line 26 can extend through the seal element 24 and the end ring 28. The line 26 may be positioned in an opening 46 bounded by the end ring body 40 and a removable portion 44 of the end ring 28.

Also provided by the above disclosure is a method of sealing an annulus 14 in a subterranean well. The method can include positioning a circumferential series of leaves 50, 52 radially outwardly overlying an annular seal element 24 of a packer assembly 12, and the leaves 50, 52 pivoting radially outward in response to swelling of the seal element 24.

The method can also include installing in the end ring body 40 an insert 54 with leaves 56 formed thereon, so that the insert leaves 56 are circumferentially offset relative to the end ring body leaves 50.

The above disclosure also describes a packer assembly 12 for use in a subterranean well, with the packer assembly 12 comprising an annular seal element 24 which swells in response to contact with a selected fluid in the well. At least one end ring 28 includes a removable portion 44 thereof engaged with a body 40 of the end ring 28 via interlocking profiles 48.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A packer assembly for use in a subterranean well, the packer assembly comprising:

an annular seal element; and at least one end ring, the end ring including multiple leaves arranged circumferentially around the end ring, wherein the leaves are biased radially outward when the seal element extends radially outward, and the end ring including at least one removable insert, the insert including a circumferential portion of the leaves, wherein the insert and the circumferential portion are removable as an integrated unit from the end ring, and wherein removal of the insert creates a gap in the leaves, thereby permitting installation of a line through the packer assembly.

2. A packer assembly for use in a subterranean well, the packer assembly comprising:

an annular seal element;

at least one end ring including multiple leaves arranged circumferentially around the end ring, wherein the leaves are biased radially outward when the seal element extends radially outward; and the end ring further including an insert, the insert including a circumferential portion of the leaves, wherein the insert and the circumferential portion constitute an integrated unit, and wherein removal of the insert creates a gap in the leaves, thereby permitting installation of a line through the packer assembly.

3. A packer assembly for use in a subterranean well, the packer assembly comprising:

an annular seal element;

at least one end ring including multiple leaves arranged circumferentially around the end ring, wherein the leaves are biased radially outward when the seal element extends radially outward; and the end ring further including a removable insert, the insert including a circumferential portion of the leaves, wherein concurrent removal of the insert and the circumferential portion creates a gap in the leaves, thereby permitting a line to be installed through the end ring from a side thereof.

4. The packer assembly of claim 3, wherein concurrent installation of the insert and the circumferential portion secures the line to the packer assembly.

5. A method of sealing an annulus in a subterranean well, the method comprising:

positioning a circumferential series of leaves radially outwardly overlying at least one end of an annular seal element of a packer assembly, a portion of the leaves being attached to a removable insert;

concurrently removing the insert and the portion of the leaves;

extending a line through the seal element;

then concurrently installing the insert and the portion of the leaves, thereby securing the line to the packer assembly; and pivoting the leaves radially outward in response to swelling of the seal element.

6. A method of sealing an annulus in a subterranean well, the method comprising:

positioning a circumferential series of leaves radially outwardly overlying at least one end of an annular seal element of a packer assembly;

the leaves pivoting radially outward in response to swelling of the seal element, wherein a first portion of the leaves are formed on an end ring; and installing in the end ring a removable insert, the insert including a second portion of the leaves formed thereon, wherein the second portion overlaps the first portion when the insert is installed in the end ring, and wherein removal of the insert creates a gap in the circumferential series of leaves, thereby permitting installation of a line through the packer assembly.

7. The method of claim 6, wherein the first and second portions are biased radially outward when the seal element swells.

8. A packer assembly for use in a subterranean well, the packer assembly comprising:

an annular seal element which swells in response to contact with a selected fluid in the well;

a circumferential series of leaves radially outwardly overlying at least one end of the annular seal element; and at least one end ring, the end ring including a first portion of the leaves formed thereon, and the end ring including a removable insert, the insert including a second portion of the leaves formed thereon, wherein removal of the insert creates a gap in the circumferential series of leaves, thereby permitting installation of a line through the packer assembly.

9. The packer assembly of claim 8, wherein the insert and the second portion are concurrently removed from the end ring.

10. The packer assembly of claim 8, wherein the insert and the second portion are concurrently installed in the end ring.

11. The packer assembly of claim 10, wherein the second portion of the leaves overlaps the first portion of the leaves when the insert is installed in the end ring.

12. The packer assembly of claim 8, wherein the first and second portions are biased radially outward when the seal element swells.

13. The packer assembly of claim 8, wherein at least one line extends through the seal element and the end ring.

14. The packer assembly of claim 13, wherein the insert secures the line to the packer assembly when the insert and the second portion are installed in the end ring.

* * * * *